US005706954A

United States Patent [19]

Detjen

[11] Patent Number: 5,706,954

[45] Date of Patent: Jan. 13, 1998

[54] SORTING AND COLLATING TRAY AND METHOD FOR SORTING AND COLLATING COLLECTIBLE CARDS

[76] Inventor: Donald E. Detjen, 50 Brookside Ave., Apt. 6A, Somerville, N.J. 08876

[21] Appl. No.: 515,735

[22] Filed: Aug. 16, 1995

[51] Int. Cl.[6] ..... B07C 7/04

[52] U.S. Cl. ..... 209/702; 209/703

[58] Field of Search ..... 209/702, 703

[56] References Cited

U.S. PATENT DOCUMENTS

| | | |
|---|---|---|
| 1,699,025 | 1/1929 | Schulz . |
| 4,209,093 | 6/1980 | Soderland . |
| 4,366,904 | 1/1983 | Roskvist . |
| 4,375,263 | 3/1983 | Dworkin . |
| 4,469,272 | 9/1984 | McFadden et al. . |
| 5,148,942 | 9/1992 | Snook . |
| 5,263,588 | 11/1993 | Bryde . |
| 5,299,688 | 4/1994 | McKay et al. . |

*Primary Examiner*—David H. Bollinger
*Attorney, Agent, or Firm*—Conrad R. Leikauf, Esq.

[57] ABSTRACT

There is disclosed a sorting and collating device for collectible cards such as sports cards. The device is designed to work with a standard cardboard card storage box, utilizing the box as the receptacle for the cards as they are being sorted and collated. After a batch is sorted and collated, the tray can be removed and used on another batch of cards, leaving the sorted and collated cards already stored in the storage box. The tray is reversible such that the available numbers on the separators corresponding to numbers on cards is doubled. In addition to the numbering, the separators can have an area suitable for affixing a tape or clip with an appropriate code or number.

9 Claims, 4 Drawing Sheets

SORTING AND COLLATING TRAY AND METHOD FOR SORTING AND COLLATING COLLECTIBLE CARDS

FIELD OF THE INVENTION

This invention relates to sorting and collating devices for, and methods for the sorting and collating of, collectable cards such as sports cards or other trading cards.

BACKGROUND OF THE INVENTION

There are many types of collectable cards such as sports cards (e.g. baseball and football) and entertainment cards. Typically these cards are approximately 3½ inches high, approximately 2½ inches wide and approximately 0.015 inches thick, and usually made of cardboard. Many collectors or sellers of these cards will buy numerous packs of cards (the packs often containing 12 cards per pack) at a time in an attempt to obtain a complete series or set. There can be several series in a set. Some of these sets can be quite large, e.g., a set of all the National Football League Players on the roster at the beginning of a season. These card packs are usually in random assortments. The purchase of numerous packs often results in having some duplicates and some absent members of the set as well.

Currently, many card collectors and resellers do not have a reusable means to sort and collate the cards in their collections. They do not have an easy way to check for duplicates and absent members in an entire series of hundreds of different members, nor do they have a means to store the cards into relatively inexpensive storage boxes as part of the sorting and collating operations.

Various sorting and storage devices have been disclosed over the years. Representative examples of these devices include the following:

Smith (U.S. Pat. No. 1,699,025) discloses a sorting tray for checks and similar small papers. There is no easily viewable area for sorting criteria codes such as numbers. Because of the nature of the tray bed, several hundred compartments of a size suitable for collectible cards would take up a vast amount of space and it would be very difficult for one person to have sufficient reach to easily sort cards into hundreds of different numbered compartments. Even after this sorting, the cards would still have to be physically moved into a suitable storage medium prior to the reuse of the tray.

The Soderland (U.S. Pat. No. 4,209,093) disclosure describes a storage box with tiltable supports designed for storing cards. Since it is a storage medium, it is necessary to physically remove any sorted cards to a different medium prior to reuse. It is designed for similarly appearing cards rather than coded cards. Accordingly, this device is for storage and not for sorting.

Roskvist (U.S. Pat. No. 4,366,094) discloses a storage container for cards with index separators. It is not suitable for sorting cards into hundreds of different members. It is not reusable for a different series or set of cards until the previously stored cards are manually removed.

Snook (U.S. Pat. No. 5,148,942) discloses a filing box with dividers. There is no provision for viewable numbers to enable its use as a sorting device as well as just a storage device. Since the device is a storage device, it is not reusable unless the stored items are physically removed from this box.

Bryde (U.S. Pat. No. 5,263,588) discloses a sports card sorting tray. It has only 10 bins, and, according to this patent's specification, it takes three of these devices to sort cards identified by a three digit code (Column 4, lines 29–31). Further, each device has a roughly 15 inch by 15 inch footprint (Column 2, line 24). Thus, three of these devices placed next to each other require almost 4 feet of width. Cards must still be manually removed, perhaps to a storage device, to reuse the sorting function of this tray.

McKay et al. (U.S. Pat. No. 5,298,688) discloses a storage device and system for card collections. The device is not suitable for easy sorting of thousands of cards into hundreds of slots. Further, this storage device is not reusable for a different series of cards until the cards are removed to another storage device.

Despite the above disclosures, there is currently no simple, inexpensive and reusable device for sorting large numbers of collectable cards into series members that contain hundreds of different members, and allowing them to be stored in the standard card storage box that is useful to serious collectors and resellers.

It would be advantageous for purchasers of collectable cards to have a device that would enable them to efficiently sort and collate their collection of cards into storage boxes.

SUMMARY OF THE INVENTION

The present invention is directed to a reusable device and method for sorting and collating large numbers of collectable cards by providing a sorting and collating tray comprising one or more rows of separators such that each row of separators corresponds to a row in a standard storage box used by many card collectors and other enthusiasts.

These storage boxes come in many sizes with frequently encountered sizes ranging from 200 card storage capacity to 5,000 card storage capacity. Two popular large sizes come in 3,200 card capacity and a 5,000 card capacity.

Each of the separators allows for numbering or otherwise identifying with a sorting criteria such that each slot identifies a particular card number or other card code. The separators are spaced sufficiently apart in the row to allow for several duplicate cards to fit between the two adjacent separators in a row. Further, the separators can be numbered on both sides in consecutive ascending order, such that the tray is reversible to double the amount of numbered slots available to sort and collate into.

The sorting criteria codes are placed in a highly visible portion of the separator to ease the eye strain upon the person performing the sorting.

The most common sorting criteria code, numbers, can be placed upon the separators at the manufacturing step to save the user of the present invention the time required to affix the hundreds of numbers that may be needed.

The separators are usually vertically oriented, but obvious variations such that they may be slightly angled so that the bottom is slightly closer to the front of the box is contemplated. Also the separators may contain a flat area for a tape with preprinted codes or blank for writing in codes. Another variation is that the separators may be fixed or adjustable to allow varying amounts of sorting space to be allocated by the user.

Furthermore, the separators may be tapered at the top edges to allow for easier viewing of the contents of adjoining compartments, and tapered at the bottom edges to assist in inserting the tray into the storage box.

When the tray is withdrawn, the space formerly occupied by the separators allows easy visual and manual access to the cards. A person can readily flip through the cards in the storage box, viewing the fronts of the cards, or reverse the box and easily view the backs of the cards.

The sides of the tray have a lip that rests upon the top of the storage box during sorting and collating, and a flange that loosely overhangs the top of the box on the outside to aid in steadying the box. The front and back pieces also form a flange that overhangs the box.

This device allows the cards to be rapidly sorted and collated while simultaneously being placed into a box for storage, inventory and transport. The tray can then be removed and used for another collating task.

Advantages of the present invention are that it is easy to use by both left and right handed persons, it can be used on the floor, or on a bed, as well as on a table. People with failing vision who have a chair in a special well-lit area can use this device on their laps with a small platform nearby to hold the cards prior to collating.

Accordingly, one embodiment of the present invention comprises a sorting and collating tray with sides and a front and back, in the form of a rectangle, with one or more rows of separators.

DETAILED DESCRIPTION OF THE INVENTION

Figure 1A:
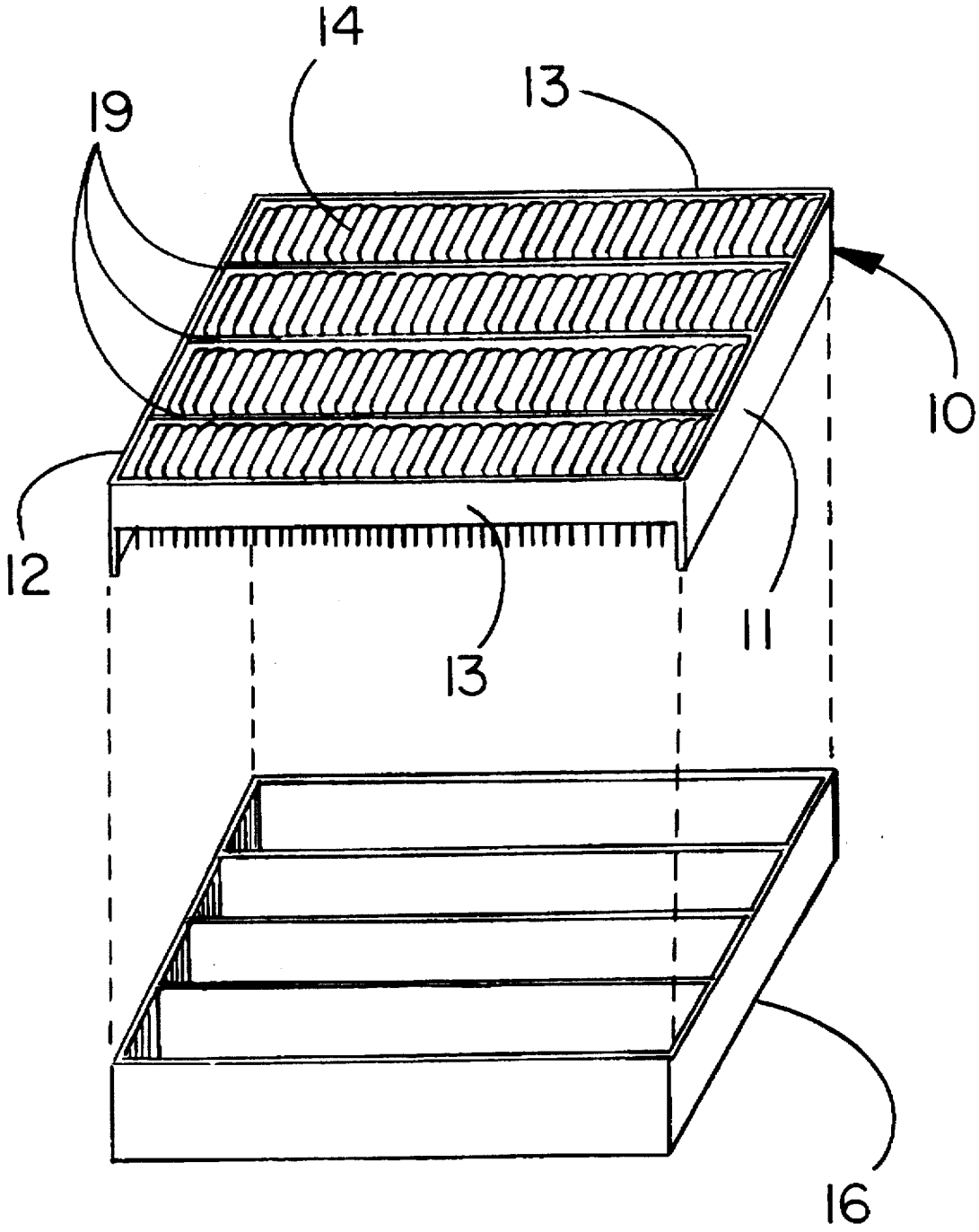
FIG. 1A is a pictorial view of the sorting and collating tray of this invention and a standard box.

Referring to FIG. 1A, sorting and collating tray (10) having a front (11), a back (12) and sides (13) that form the outer boundary for the device of the present invention wherein a plurality of separators (14) are placed in rows and, depending on the configuration of the storage box (16) (shown but not claimed is a popular 3,200 card capacity storage box) it affixes to, one or more rows. If the storage box has more than two rows, the tray (10) will have one or more ribs (19) running between the front piece (11) and the back piece (12), parallel to the side pieces (13).

Figure 1B:
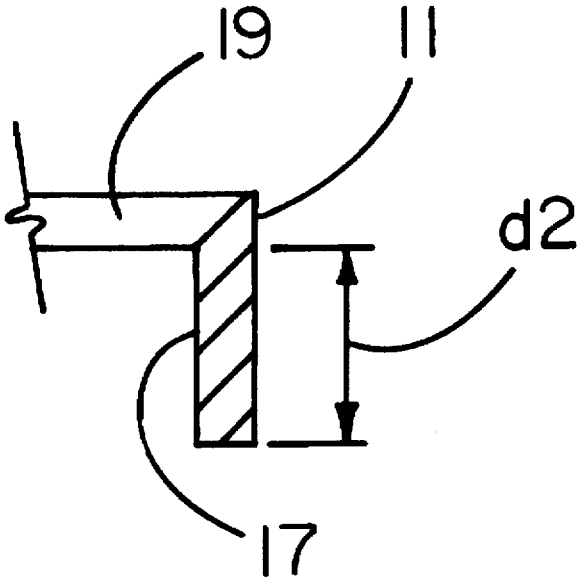
FIG. 1B is a view of the front rear flange.
Figure 1C:
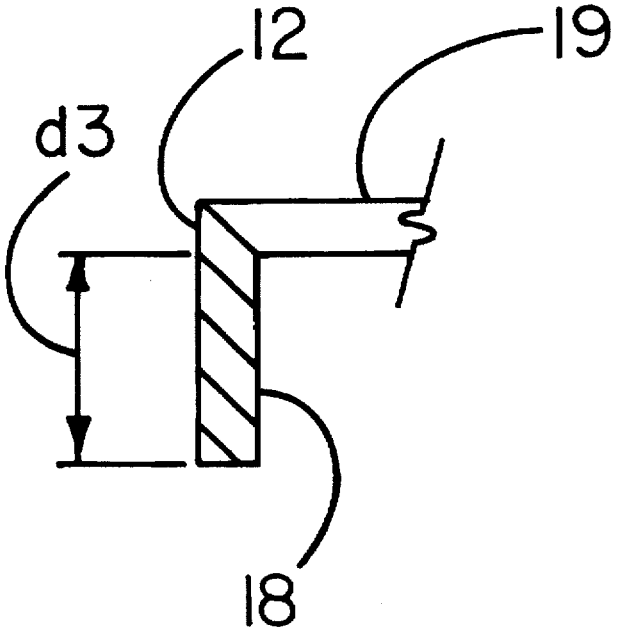
FIG. 1C is a view of the rear flange.

Referring to FIG. 1B, the front piece (11) overhangs the front of the storage box forming the front flange (17) having a depth (d2); likewise, referring to FIG. 1C, the back piece (13) overhangs the back of the storage box to form the back flange (18) having a depth (d3). The depth of the front flange (d2) and the back flange (d3) is preferably on the order of ½ inch to 1¾ inches but can be somewhat shorter or longer.

Figure 3A:
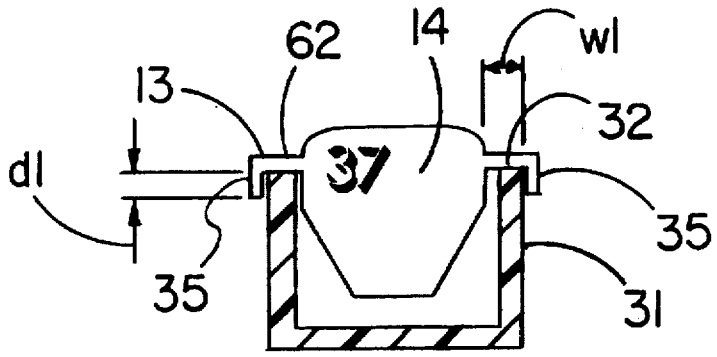
FIG. 3A is a front sectioned view of the sorting and collating tray of this invention operating with a single row storage box.

Refer to FIG. 3A. Preferably, the interiors of the side pieces (13) of the tray are properly spaced and sufficiently wide such that these pieces have an interior lip (32) that rests on the outer top surfaces of a single row storage box (31) and side flanges (35) that extends below the box on the outside to steady the tray during use. The width of the lips (w1) is determined by the need to reliably space the flange beyond the sides of the storage box (31) within the tolerances of the storage box and of the tray manufacturing process and the need to reduce the side-to-side movement of the tray once placed upon the box. The depth of the flanges is on the order of ½ inch to 1¾ inches, with depth of the side flange (d1) not needing to be as deep as the front and back flanges because the separators provide some limitation on side-to-side motion of the tray on the box.

Figure 2:
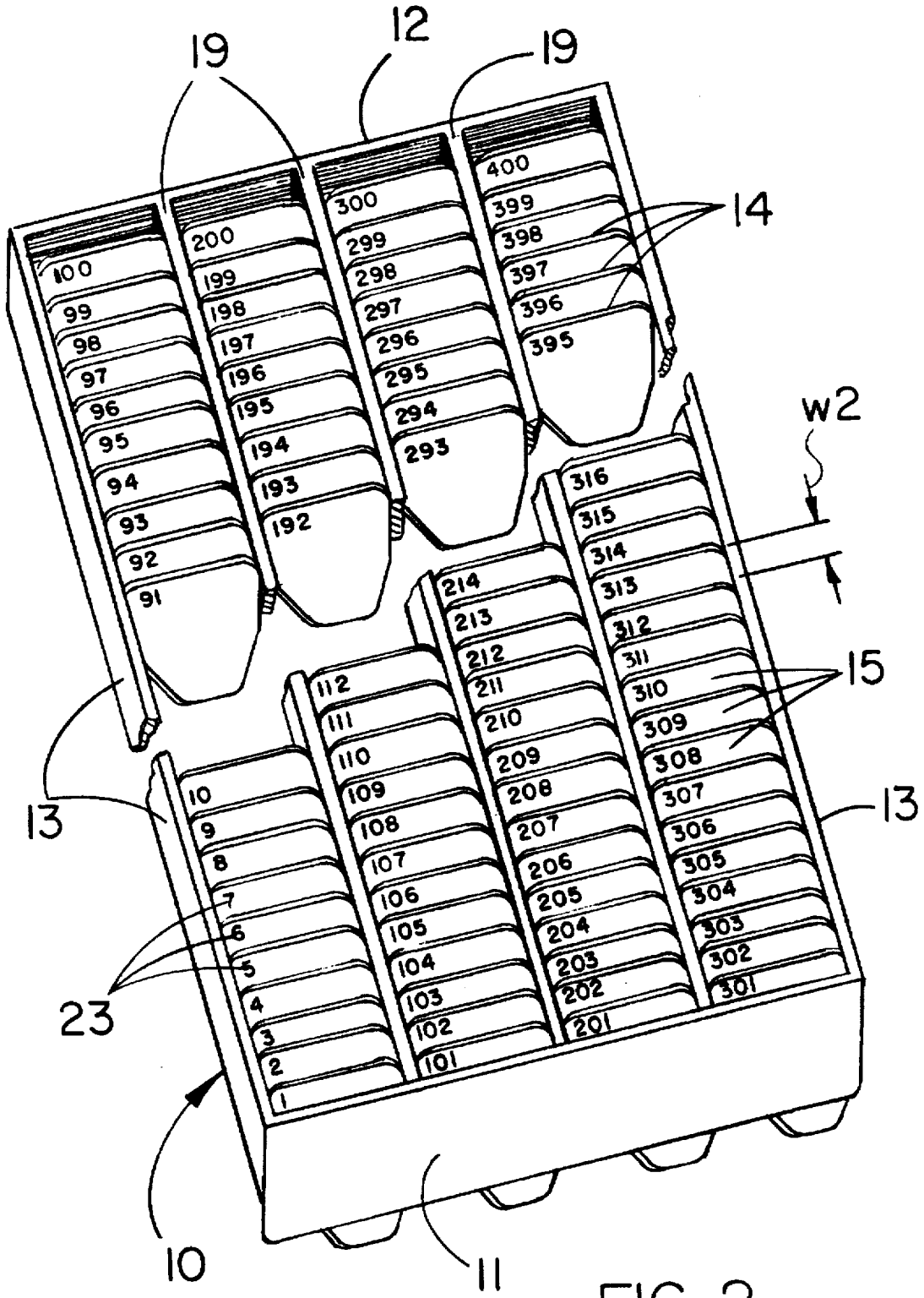
FIG. 2 is a sectioned view from the top.

Referring to FIG. 2, in tray (10), the separators (14) are spaced sufficiently apart (w2) from each other in the row to allow for several duplicates to fit between them. Referring to FIG. 2, the width of the separators (w2) is approximately the same as that of the card to be stored. This insures that once the tray is inserted into the storage box it will be aligned sufficiently to place cards into the slots (15) described by the separators (14), the ribs (19) if so configured, the front piece (11), the back piece, when the tray is reversed (12), and the side pieces (13).

Figure 3B:
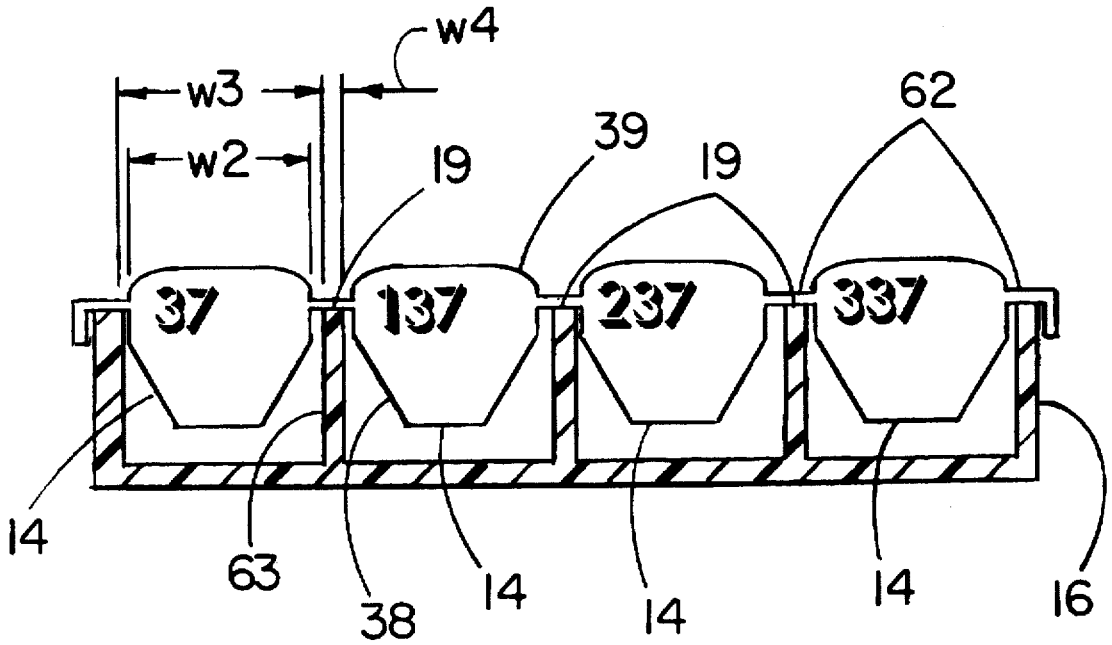
FIG. 3B is a front sectioned view of the sorting and collating tray of this invention working with a four row storage box.

Referring to FIG. 3B, separators (14) preferably are vertical and are slightly less wide (w2) than the interior width of the row (w3) of the card storage box (16). This allows for easy insertion of the tray (10) into the storage box (16). To further ease the insertion of the tray into a storage box and align it therein, the bottom of each separator is cut at an acute angle, preferably between 15 degrees and 45 degrees (38).

Continue referring to FIG. 3B. Preferably, the top of each separator is tapered (39) sufficiently to allow the person sorting and collating the cards to view the cards in the adjacent areas.

Referring to FIG. 3A, the separators (14) have arms (62) which are used to connect the separators to the side pieces (13) in a single row configuration.

Referring to FIG. 3B, in multiple row arrangements, the row of separators adjacent to the side pieces are connected by the arms (62) to the side pieces (13) on one side and to a rib (19) running between the front piece and the back piece (as shown in FIG. 1.) Interior separators are connected by arms (62) on both sides of the separator to the ribs (19) running between the front piece and the back piece (as shown on FIG. 1). The ribs must be thin enough so as to enable the cards to be placed into a slot without any binding and also allow the tray to be removed from the storage box without lifting any cards out of the storage box. Their width (w4) should be on the order of the row dividers (63) of the storage box (16).

Each separator is sequentially numbered (23) to assist in the sorting and collating of the collectable cards into the appropriately coded slot (15) by giving it an identity. However, different numbers or other codes, such as colors or alphanumeric, may be affixed to the separator by tape or other means to change the identity of the slot so formed.

Figure 4:
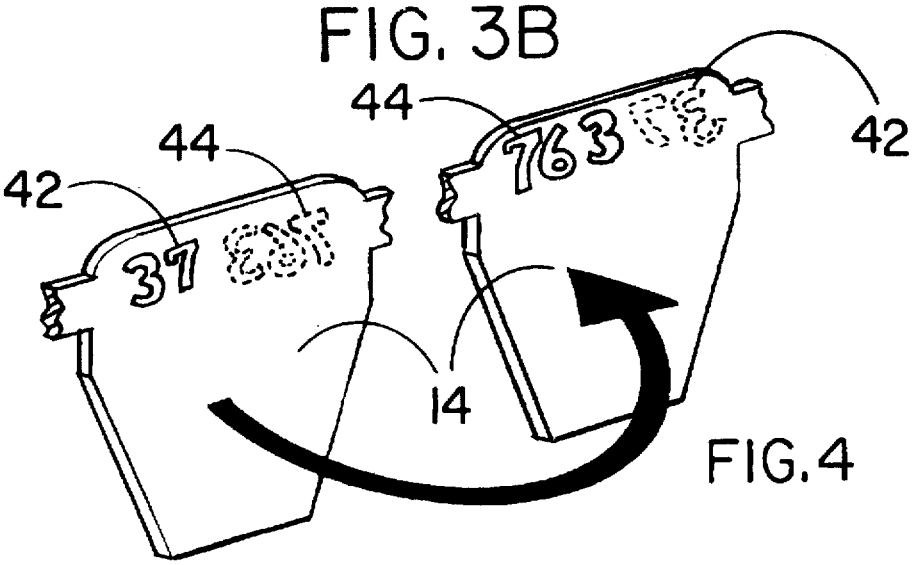
FIG. 4 is an enlarged view of a separator having numbers on both sides.

In the preferred embodiment, the tray has solid front, back and side pieces. The tray is divided into four rows that align with the four rows of the 3,200 card capacity storage box. Each row of the tray contains 100 separators. Referring to FIG. 4, the separators (14) are numbered sequentially from "1" to "400" (42) facing in one direction, and from "401" to "800" (44) on the opposite faces, such that one series of cards, typically 700–800 different cards, can be sorted by code, such as a card number by reversing the tray.

To use the tray of the present invention on a set of cards having 3 series of 250 cards each, a person places a storage box on a floor, table or other suitably firm platform. The sorting and collating tray of the present invention is placed onto the storage box oriented for the number sequence desired, such as cards numbered 1 to 400. The cards to be sorted and collated are placed conveniently nearby. The individual cards are inserted into the appropriate, specific slot, or stacked nearby if their codes are above the number 400. After this first run, an inventory can then be taken of the number of cards in each slot, including duplicates and missing members. This information can be written on a paper inventory sheet or into a notebook but is frequently entered into a computer database. The tray can then be removed. If there are cards which were placed aside, another storage box is placed in a suitable location as above, the tray is placed onto the storage box, having the orientation of the tray rotated by 180 degrees such that the numbers 401–800 are now visible to the person sorting and collating. The steps of inserting the cards, inventorying the cards and removing the tray are repeated.

Suitable materials for making the tray and separators includes, but is not limited to, plastic, wood, fiberboard, cardboard, and aluminum, for example.

What I claim is:

1. A reusable tray for sorting and collating cards which comprises:

(a) a front support member;

(b) a back support member;

(c) two side support members attached to the front support member and the back support members to form a rectangle, open at the top and bottom, which is attachable to the top of a storage device; and (d) one or more rows of separators placed within the rectangle and connected by arms to the side support members and/or to ribs running between the front support member and the back support member, said ribs running parallel to the side support members.

2. A tray as in claim 1 wherein the separators upper edges are tapered.

3. A tray as in claim 1 wherein the separators lower edges are tapered.

4. A tray as in claim 1 wherein the separators have sequential numbers starting with "1" molded onto the separators.

5. A tray as in claim 4 wherein the number series is continued on the opposite side of the separators and is reversible.

6. A tray as in claim 1 wherein the separators are vertical.

7. A tray as in claim 1 wherein the separators are slightly inclined.

8. A method for collating/sorting trading cards into a storage device, which comprises the steps of:

(a) gathering the cards to be sorted/collated;

(b) placing the sorting/collating tray onto a storage device such as a storage box;

(c) inserting the individual cards into a specific slot by a code such as card number;

(d) assessing the duplicates and missing members of a series of cards; and (e) removing the tray from the storage device.

9. A method for collating trading cards into a storage device as in claim 8, which comprises the additional steps of:

(a) rotating the tray 180 degrees such that the reverse side of the separators are exposed;

(b) placing the sorting/collating tray onto a storage device such as a storage box;

(c) inserting the individual cards into a specific slot by a code such as card number;

(d) assessing the duplicates and missing members of a series of cards; and (e) removing the tray from the storage device.

* * * * *